United States Patent [19]

Shibata

[11] Patent Number: 4,472,211

[45] Date of Patent: Sep. 18, 1984

[54] METHOD OF INTERNALLY OXIDIZING AG-SN ALLOY CONTACT MATERIAL

[75] Inventor: Akira Shibata, Yokohama, Japan

[73] Assignee: Chugai Denki Kogyo Kobushiki Kaisha, Japan

[21] Appl. No.: 380,073

[22] Filed: May 20, 1982

[51] Int. Cl.[3] ..... C21D 1/78

[52] U.S. Cl. ..... 148/20.3; 148/431

[58] Field of Search ..... 148/1.5, 430, 13.1, 148/431, 20.3; 420/501, 504, 506; 428/671, 673

[56] References Cited

U.S. PATENT DOCUMENTS 4,246,321 1/1981 Shibata ..... 428/614

FOREIGN PATENT DOCUMENTS 2102996 of 1972 Fed. Rep. of Germany ..... 428/673
13301 5/1970 Japan ..... 420/506
73274 6/1979 Japan .
43776 3/1980 Japan ..... 420/501
35736 4/1981 Japan ..... 420/501

*Primary Examiner*—L. Dewayne Rutledge
*Assistant Examiner*—Christopher W. Brody
*Attorney, Agent, or Firm*—Shlesinger, Fitzsimmons & Shlesinger

[57] ABSTRACT

Rather high temperature raise of internally oxidized Ag-Sn alloy contact materials due to a high contact resistance inherent to such materials, is eliminated. The high contact resistance which is caused by high concentration or supersaturation of metal oxides including tin oxides about contact surfaces, is avoided by having solute metals sublimated, reduced or extracted about the contact surface before the internal oxidation thereof. Sublimation and other treatments may be made after having the materials subjected to internal oxidation.

1 Claim, 4 Drawing Figures

METHOD OF INTERNALLY OXIDIZING AG-SN ALLOY CONTACT MATERIAL

BACKGROUND OF THE INVENTION

Silver alloys, matrices of which contain metal oxides are useful as electrical contact materials, since the oxides are refractory and they prevent electrical contacts from melting by arcs produced with their opening and closing operations and consequently prevent the contacts from welding to each other.

Hence, it is easily conceivable that the higher a concentration of metal oxides in a silver alloy is, the higher refractoriness of the alloy becomes. However, when a silver alloy contains solute metals of more than 4 weight % in total, they can not be successfully internally-oxidized. For example, tin which is contained in a silver alloy at an amount of more than about 4 weight %, can not be internally oxidized, while its concentration is on the other hand limited to about 25 weight % at maximum on account of its solid solubility with silver.

In view of the above, the successful internal oxidation of silver alloys containing about 4 to 25 weight % of tin had been sought for many years, and has been attained for the first time by the present inventor as described in U.S. Pat. No. 3,933,485 (internally oxidized Ag-Sn-In system alloy contact materials) and in U.S. Pat. No. 3,933,486 (internally oxidized Ag-Sn-Bi system alloy contact materials).

Though the above-mentioned internally oxidized Ag-Sn system alloys are commercially and industrially acceptable as electrical contacts, their contact resistance particularly at an initial stage of use is somewhat high, compared to those contact materials which are made by a powder-metallurgical method and contain corresponding amounts of metal oxides. Apart from the comparatively high contact resistance the former present, which induces sometimes a high degree of temperature raise at contact surfaces, they are of course far superior to the latter, which are powder-metallurgically prepared, with respect to other electrical and physical characters and properties. Particularly, powder-metallurgical materials are inherently coarse, as they are made from powders.

BRIEF SUMMARY OF THE INVENTION

It has been observed that the aforementioned kind of internally oxidized silver alloy contact materials, viz., internally oxidized Ag-Sn-In and Ag-Sn-Bi system alloy contact materials, tin contents of which are about 4 to 25 weight % or solute metals including tin of which are more than 4 weight % in total, have tortoise-shell patterned silver grain boundaries, diameters of which are about 50 to 100 $\mu$, and around which the precipitation of solute metal oxides are produced. And, it is now found that those metal oxides including tin oxides which are precipitated around silver gain boundaries of the topmost and adjacent layers and exposed to a contact surface, and concentration or intensity of which is higher than that of metal oxides precipitated in inner or deeper parts, cause contacts to have a high contact resistance and to raise their temperature when they are subjected to opening and closing cycles. It is also found that with opening and closing cycles, metal oxides lying inside contact materials, tend to come upwards and on the contact surfaces. The above was confirmed by X. M. A. observations. To wit, the gradient curve of intensity or concentration of tin oxides in the materials is the one having the maximum at their contact surfaces, the first point of inflexion at about 10 to 15 $\mu$ from the contact surfaces, which point is followed by a flat curve of an average level of intensity, the second point of inflexion adjacently to a central core portion, and the minimum at said core portion. The value at the maximum of the curve amounts sometimes as much as about 5 times of the average level of intensity.

It is, therefore, the object of this invention to eliminate or normalize a high intensity of supersaturation of solute metal oxides including tin oxides extending from the maximum to the first point of inflexion of the aforementioned curve, to an amount substantially equal to or less than the average level of intensity or concentration, whereby internally oxidized silver alloys have, at their contact or outer surfaces and adjacent parts thereof, metal oxides including tin oxides of such concentration which is substantially equal to or less than their average level of concentration, and whereby electrical contacts made therefrom shall have a lower contact resistance and consequently free from a high degree of temperature raise.

In this invention, more concretely silver alloys which are to be internally oxidized or have been internally oxidized and which contain solute metals including tin of an mount more than 4 % in total, are subjected, prior to or after the internal oxidation, to a non-oxidizing or reducing atmosphere such as hydrogen or argon atmosphere or under vacuum, and to an elevated temperature, so that concentration of solute metals or oxides thereof lying at and adjacently to contact or outer surfaces thereof is decreased, by the partial sublimation, reduction, or extraction thereof. Rate of sublimation is controlled to such extent that tin and/or other solute metals' concentration in the alloys at an area extending from the maximum to the first point of inflexion of its gradient curve shall be lower than its average level, and that it shall be substantially equal to or less than said average level, when the alloys have been internally oxidized. It shall be worthwhile to mention, in this connection, that since vapor pressure of tin is moderate, such control can readily be made, and tin concentration in inner part of alloys shall not be adversely affected.

It shall be noted also that in this invention, in addition to or in replacement in part of tin, other solute metals such as Zn, Sb, Pb, Bi, In and so on can be used, and that addition of the element of the iron or alkali earth metal group gives effect the formation of the uniform microcrystals in the structure of internal oxidation. It shall be noted further that concentration of solute metals including tin at and adjacent to a contact surface is controlled preferrably before internal oxidation, while such control may be made after internal oxidation by subjecting internally oxidized materials to a high temperature in a non-oxidizable or reducing atmosphere or under vacuum. Or, concentration of metal oxides about outer surfaces of internally oxidized silver alloy can be decreased by immersing them to a reducing atmosphere such as molten reducing flux.

DETAILED DESCRIPTION OF THE INVENTION

This invention is described below further in detail by way of examples.

Examples:

(1) Ag-Sn 3 w %-In 13 w %-Fe 0.1 w %

(2) Ag-Sn 8 w %-In 4 w %-Ni 0.1 w %

(3) Ag-Sn 8 w %-Bi 1 w %-Ni 0.2 w %

(4) Ag-Sn 6 w %-Bi 0.5 w %-Cd 5 w %-Ni 0.2 w %

Alloys of the above (1) to (4) were melted in a high frequency melting furnace at about 1,100 to 1,200° C., and poured into a mold for obtaining ingots of about 5 Kg. Each ingot was stripped at its surface. Then, each ingot was butted at its stripped surface to a pure silver plate by means of a hydraulic press, platen of which was heated at about 400° C., and rolled to a plate of 2 mm thickness, while it was annealed at about 600° C. at every stages of rolling rates of 30% in reduction.

(A) Treatment Prior to internal oxidation:

The plates thus obtained as described in the above, were subjected to 700° C. atmosphere of $H_2$ for about 10 minutes.

(B) Internal oxidation:

Each plate thus treated by the above (A) was internally oxidized in an oxygen atmosphere for 200 hours and at 650° C. Then, internally oxidized plates were pressed by a punch of 6 mm in diameter to obtain electrical contacts of 6 mm and 2 mm in thickness which were backed with a thin silver layer.

The above contact samples of alloys (1)-(4) which had been subjected to both of the above (A) and (B) steps (referred to in the following table as "this invention samples" (1)-(4)), and contact samples of the alloys (1)-(4) which had been subjected only to the above step (B) (referred to in the following table as "prior-known samples" (1)-(4)) were checked of their initial contact resistance, and of temperature raise (above room temperature) which was measured at terminals at the 1,000th cycle, under ASTM-50 test with the following conditions.

Intial contact resistance:

Contact pressure—400 g

Current—DC 6V, 1A

Temperature raise:

Load—AC 200V 50A pf=0.23

Frequency—60 cycles/minute

TABLE 1

| | | initial contact resistance (mΩ) |
|---|---|---|
| "this invention sample" | (1) | 0.7–1.6 |
| | (2) | 0.8–2.1 |
| | (3) | 0.6–1.4 |
| | (4) | 0.8–1.2 |
| "prior-known sample" | (1) | 0.9–2.4 |
| | (2) | 1.2–2.3 |
| | (3) | 0.7–2.1 |
| | (4) | 0.9–1.8 |

TABLE 2

| | | temperature raise (°C.) |
|---|---|---|
| "this invention sample" | (1) | 31.4 |
| | (2) | 35.8 |
| | (3) | 28.6 |
| | (4) | 25.6 |
| "prior-known sample" | (1) | 37.2 |
| | (2) | 44.3 |
| | (3) | 41.0 |
| | (4) | 37.8 |

Thus, it is known from the above tables that contact materials made in accordance with this invention have lower contact resistance and less temperature raise, compared to corresponding prior-known contact materials.

Figure 1:
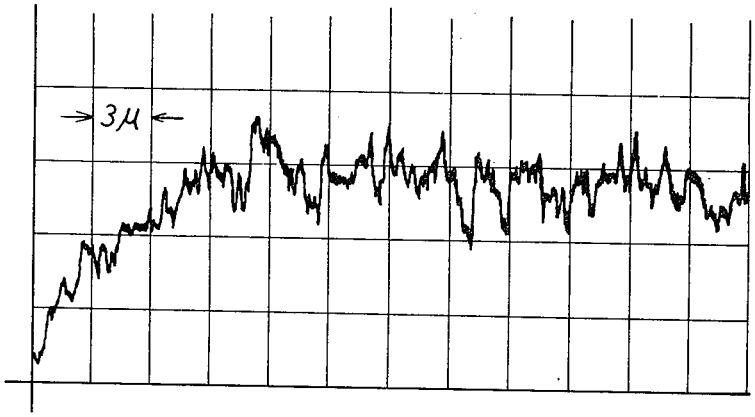
FIG. 1 is a copy of X. M. A. line scanning pen-recorded chart of an internally oxidized contact material made in accordance with this invention, in which the vertical axis shows intensity of Sn spectrum and the horizontal axis depth from the outer surface of the material.
Figure 2:
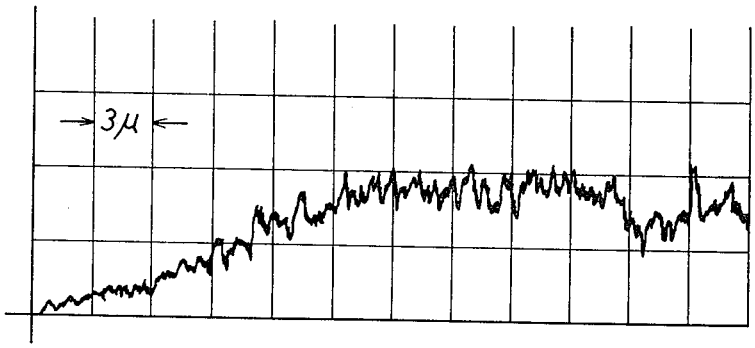
FIG. 2 is a chart same to FIG. 1, in which its vertical axis shows In spectrum.
Figure 3:
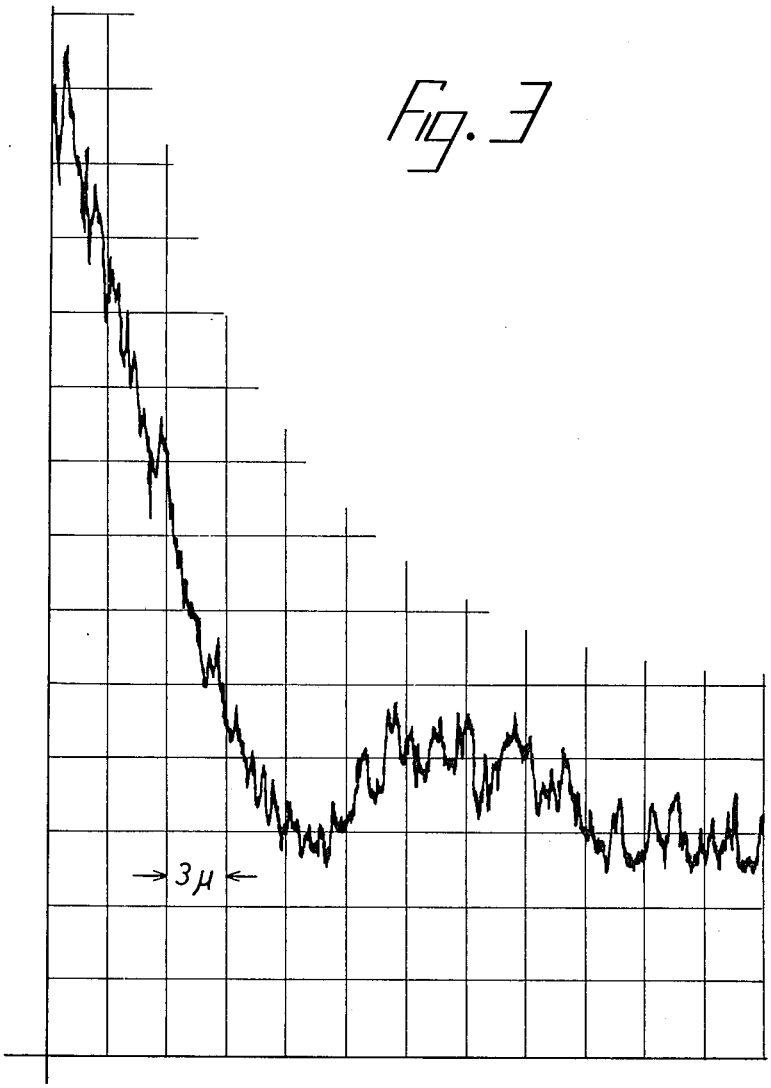
FIG. 3 is also a chart same to FIGS. 1 and 2, of a prior-known or conventionally internally oxidized material, in which its horizontal axis shows depth from the contact surface, and vertical axis Sn intensity.
Figure 4:
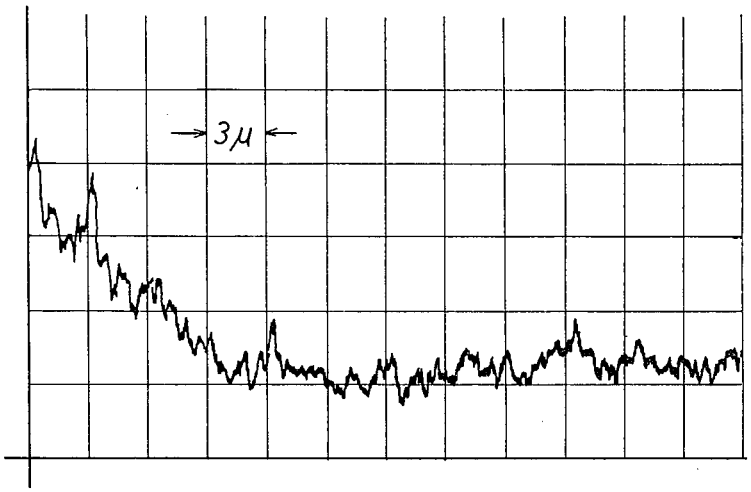
FIG. 4 is a chart same to FIG. 3, in which its vertical axis shows In spectrum.

The above "this invention sample" (2) and "prior-known sample" (2) were examined by X. M. A. line scanning (KV-°μA, crystal—P.E.T., and full scale—300 cps) of their Sn and In spectrums. The abbreviation P.E.T., as used above refers to pentaerythritol, which has the chemical formula $C(CH_2OH)_4$. They are as shown in FIGS. 1 to 4, wherein FIGS. 1 and 2 illustrate how the concentrations of Sn and In in samples prepared according to this invention are considerably reduced adjacent the contact surfaces of the alloy materials, while FIGS. 3 and 4 illustrate the undesirable high concentrations of Sn and In which exist near the outer contact surfaces of the alloy materials which are prepared with known internally oxidizing processes which are not subjected to the above-noted treatment (A) prior to the internal oxidation of the materials.

I claim:

1. A method for preparing silver alloy materials for making electrical contacts, which comprises subjecting, prior to internal oxidation, a silver alloy, which contains solute metals including tin in an amount more than 4 % of the total weight of the alloy, to a heat treatment in an atmosphere and a temperature which, through partial sublimation, reduction or extraction thereof, lowers the concentration of solute metal elements, including tin, about the outer contact surfaces of the alloy, so that the concentration of the oxides about said contact surfaces is substantially equal to or less than the average level of concentration of oxides in the alloy, when said alloy is internally oxidized, and thereafter subjecting the alloy to internal oxidation.

* * * * *